US005533949A

United States Patent [19]

Hwang

[11] Patent Number: 5,533,949

[45] Date of Patent: Jul. 9, 1996

[54] HAND-MUSCLE DEVELOPER WITH MUSIC PRODUCING MEANS

[76] Inventor: Chyh-Wen Hwang, No. 124, Chung Hsing Rd., Hsin Feng Hsieng, Hsinchu Hsien, Taiwan

[21] Appl. No.: 364,814

[22] Filed: Dec. 27, 1994

[51] Int. Cl.[6] ..... A63B 23/16

[52] U.S. Cl. ..... 482/47; 601/40; 446/397; 84/465

[58] Field of Search ..... 446/143, 397, 446/408; 84/465, 467, 468; 482/44, 47, 49; 601/40

[56] References Cited

U.S. PATENT DOCUMENTS

| | | | |
|---|---|---|---|
| 3,738,651 | 6/1973 | Norman et al. | 482/47 |
| 4,678,181 | 7/1987 | Ditsch et al. | 482/47 |
| 4,794,840 | 1/1989 | Isashi | 84/467 |
| 4,974,486 | 12/1990 | Wallace | 446/408 X |
| 4,986,792 | 1/1991 | Chen | 446/408 |

*Primary Examiner*—Richard J. Apley
*Assistant Examiner*—David R. Risley

[57] ABSTRACT

A hand-muscle developer including a casing, a strap for fastening the casing to the hand, a music IC circuit board installed inside the casing, a speaker mounted on the casing and connected to the music IC circuit board, a battery power supply to provide power supply to the music IC circuit board, a plurality of melody keys mounted on the casing and respectively depressed by fingers to make electrical contact for triggering the music IC circuit board to produce a specific tone through the speaker, and a tuning means mounted on the casing and controlled by the thumb to tune the tones triggered by the melody keys.

5 Claims, 6 Drawing Sheets

HAND-MUSCLE DEVELOPER WITH MUSIC PRODUCING MEANS

BACKGROUND OF THE INVENTION

The present invention relates to hand-muscle developers for exercising the hand, and relates more particularly to such a hand-muscle developer which produces sweet sounds when operated by fingers.

A variety of music toys have been disclosed, and have appeared on the market. These music toys produce sounds when played. However, these music toys cannot be used as exercising apparatus. There are also known various hand-muscle developers designed for exercising the muscles of the hands. These hand-muscle developers are functional, however they are monotonous, and the players will soon be tired of playing with them.

SUMMARY OF THE INVENTION

The present invention has been accomplished under the circumstances in view. It is one object of the present invention to provide a hand-muscle developer which is functional for exercising the fingers. It is another object of the present invention to provide a hand-muscle developer which produces sounds when it is played. It is still another object of the present invention to provide a hand-muscle developer which can be conveniently fastened to the hand for exercising the fingers.

According to one aspect of the present invention, the hand-muscle developer comprises a casing, a music integrated circuit (IC) circuit board installed inside the casing, a speaker mounted on the casing and connected to the music IC circuit board, a battery power supply to provide power supply to the music IC circuit board, and a plurality of melody keys mounted on the casing and respectively depressed by fingers to make electrical contact for triggering the music IC circuit board, to produce a specific tone through the speaker.

According to another aspect of the present invention, a tuning means is mounted on the casing for tuning the tones triggered by the melody keys.

According to still another aspect of the present invention, a strap is fixed to the casing so that the casing can be conveniently fastened to the hand for exercising the fingers.

DETAILED DESCRIPTION OF THE PREFERRED EMBODIMENT

Figure 1A:
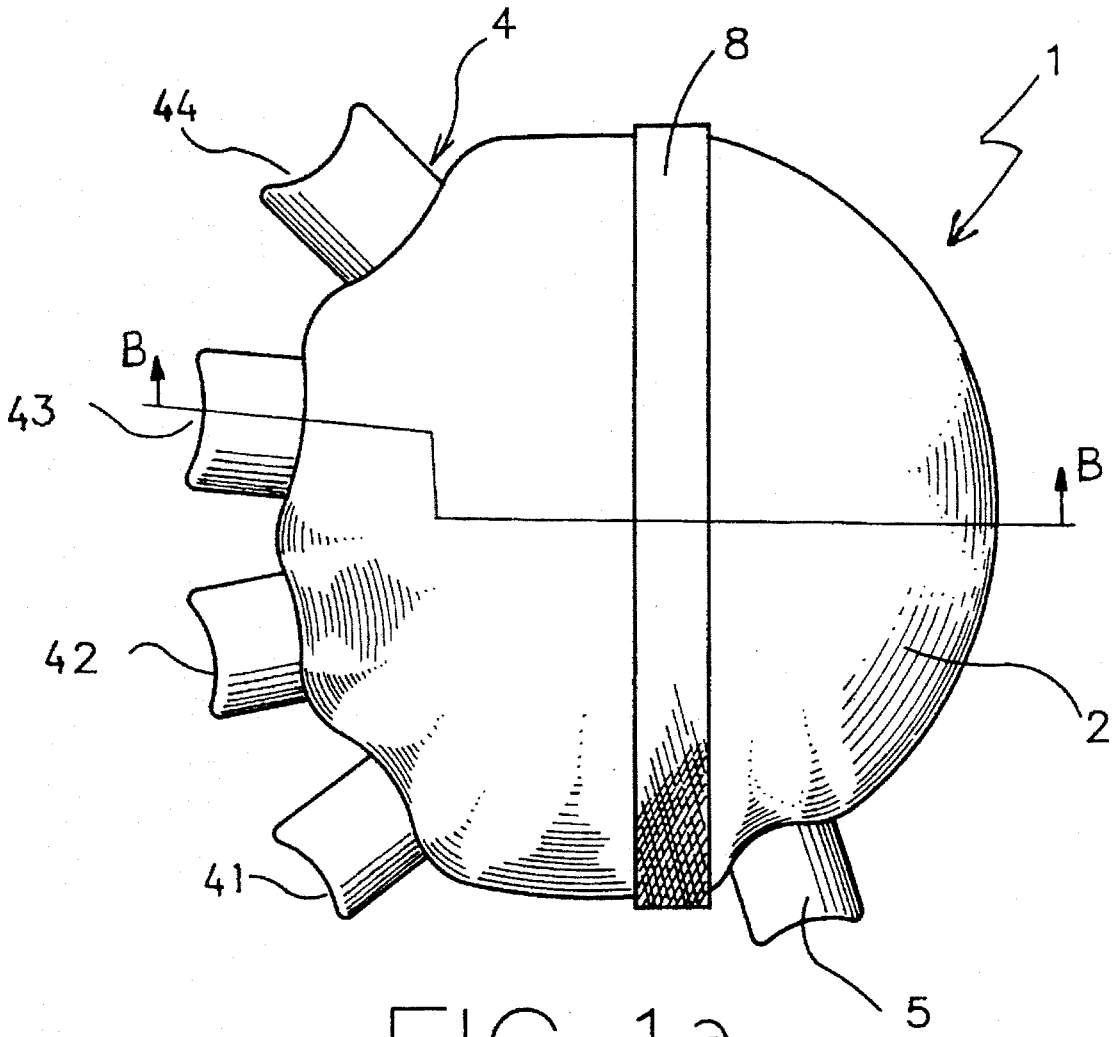
FIG. 1*a* is a top view of a hand-muscle developer according to the present invention.
Figure 1B:
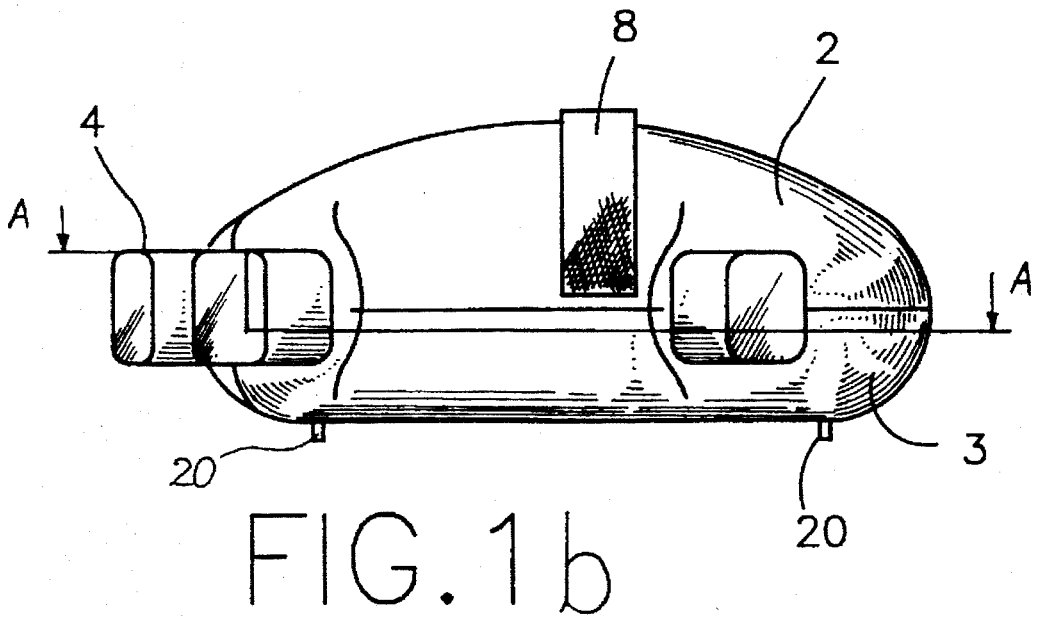
FIG. 1*b* is a side view of the hand-muscle developer shown in FIG. 1*a;*

Referring to FIGS. 1*a*, 1*b*, 2*a*, and 2*b*, a hand-muscle developer 1 in accordance with the present invention is generally comprised of a casing, which consists of two symmetrical half shells, namely the upper shell 2 and the bottom shell 3 connected together, a set of melody keys 4, a tuning means 5, a speaker 6, a music IC circuit board 7, a strap 8, and a battery box 14.

The casing 2 and 3 is orthopedically engineered to fit the palm, having a plurality of melody key chambers 9 and tuning key chamber 9' spaced along the connecting area between the upper and bottom shells 2 and 3 on the outside. Each key chamber 9 or 9' has a respective upright, tubular spring holder 23 to hold a respective spring 10 or 10' (see also FIGS. 3 and 4). The strap 8 is fixed to the casing 2 and 3 for fastening it to the hand. The music IC circuit board 7 is fastened to inside posts 12 of the upper shell 2 by screws 11. The bottom shell 3 has four legs 20 on the outside, by which the hand-muscle developer 1 can be supported on the ground or a table, a grille 13, and a plurality of supports 21 on the inside around the grille 13. The speaker 6 is fastened to the supports 21, disposed toward the grille 13, and electrically connected to the music IC circuit board 7. The battery box 14 is disposed inside the casing 2 and 3 to hold a battery set 15, and electrically connected to the music IC circuit board 7. The set of melody keys 4, namely, the melody keys 41, 42, 43, and 44 are respectively fastened to melody key chambers 9 and respectively operated by four fingers to make electrical contact for triggering the music IC circuit board 7, to produce different tones. The tuning key 5 is fastened to a tuning key chamber 9' and operated by the thumb for tuning.

Figure 2A:
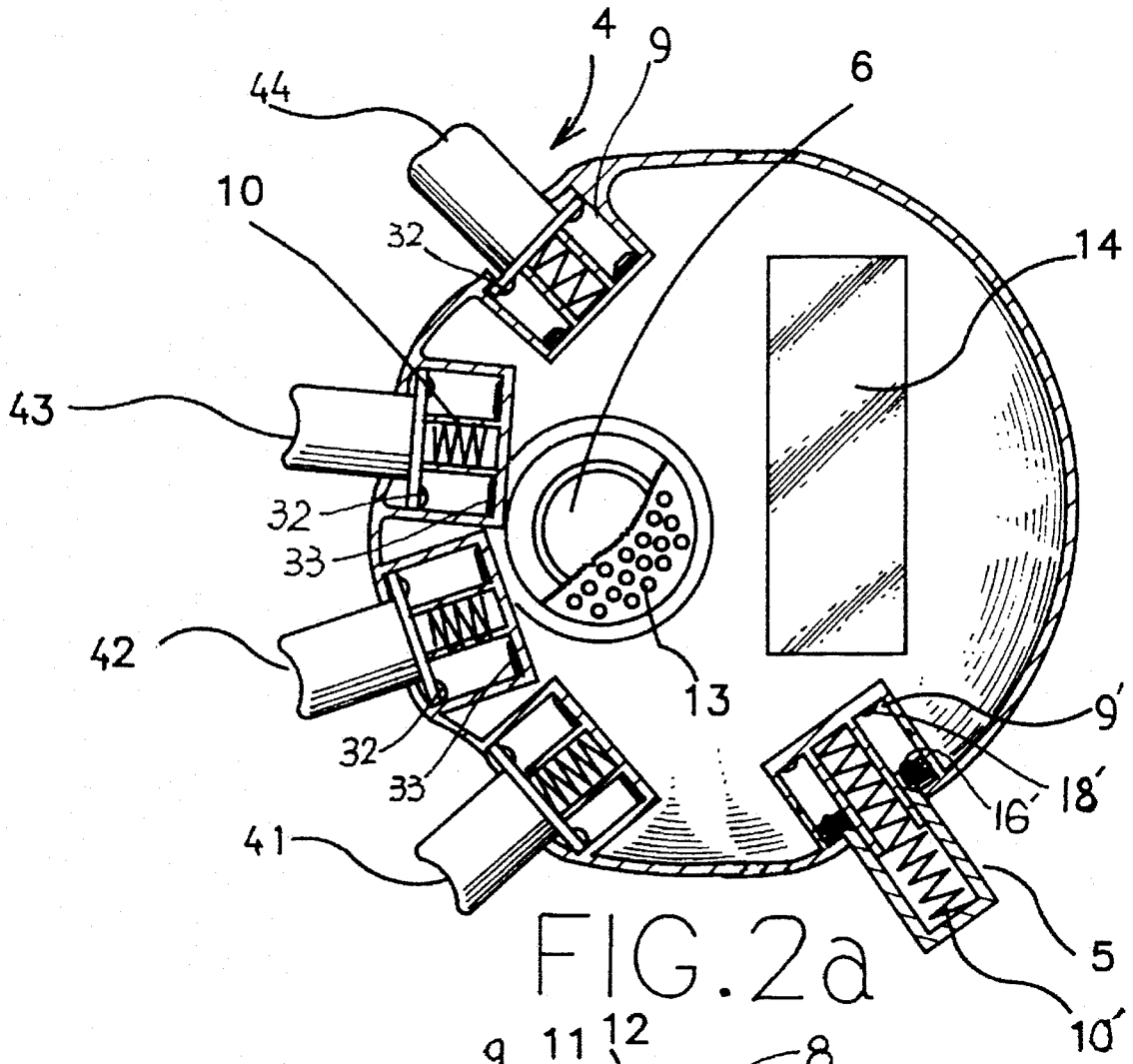
FIG. 2*a* is a sectional view according to the section line A—A of FIG. 1*b;*
Figure 2B:
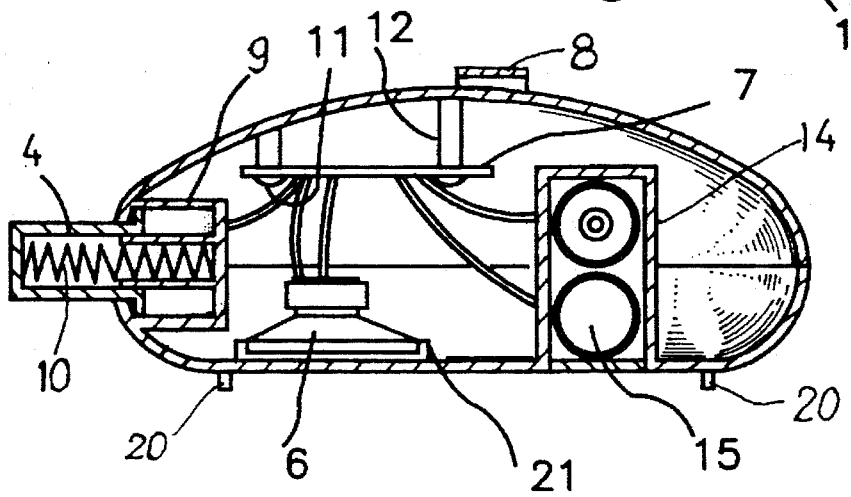
FIG. 2*b* is a sectional view according to the section line B—B of FIG. 1*a;*
Figure 3:
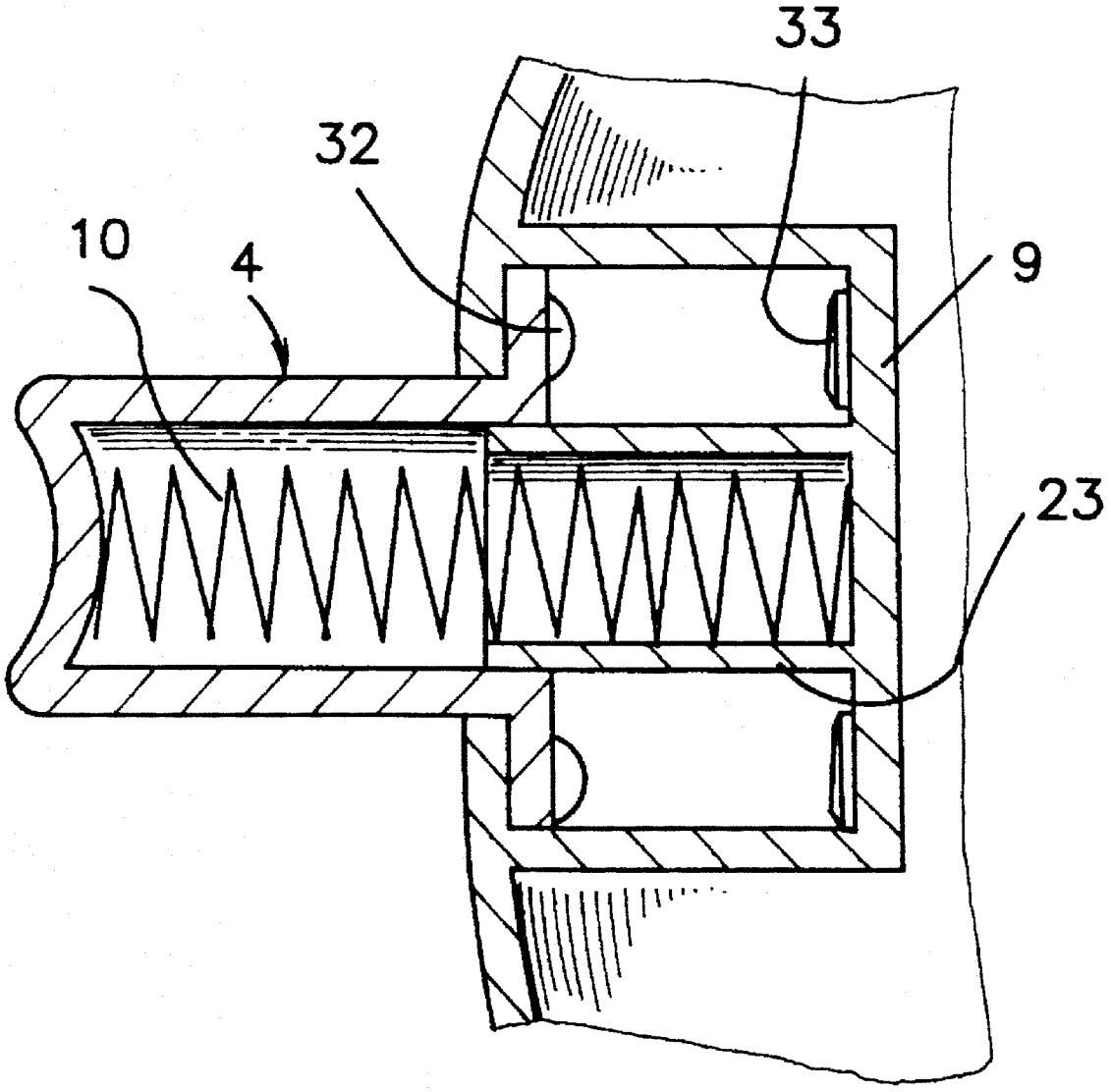
FIG. 3 is a partial view in an enlarged scale of the hand-muscle developer shown in FIG. 1*a*, showing the positioning of one melody key.

Referring to FIG. 3 and FIGS. 2*a* and 2*b*, each melody key 4 is supported on a spring 10 in a tubular spring holder 23 inside one key chamber 9, having two contacts 32 bilaterally disposed at the bottom. The melody key chamber 9 has two opposite contacts 33 disposed at locations corresponding to the contacts 32 on the melody key 4 and electrically connected to respective contacts (not shown) on the music IC circuit board 7. When the melody key 4 is depressed by one finger, the contacts 32 of the melody key 4 are forced to contact the contacts 33 respectively, causing the music IC circuit board 7 to produce a specific tone through the speaker 6. When the melody key 4 is released from the finger, the spring 10 automatically forces the melody key 4 back to its former position, and therefore the contacts 32 are disconnected from the contacts 33.

Figure 4:
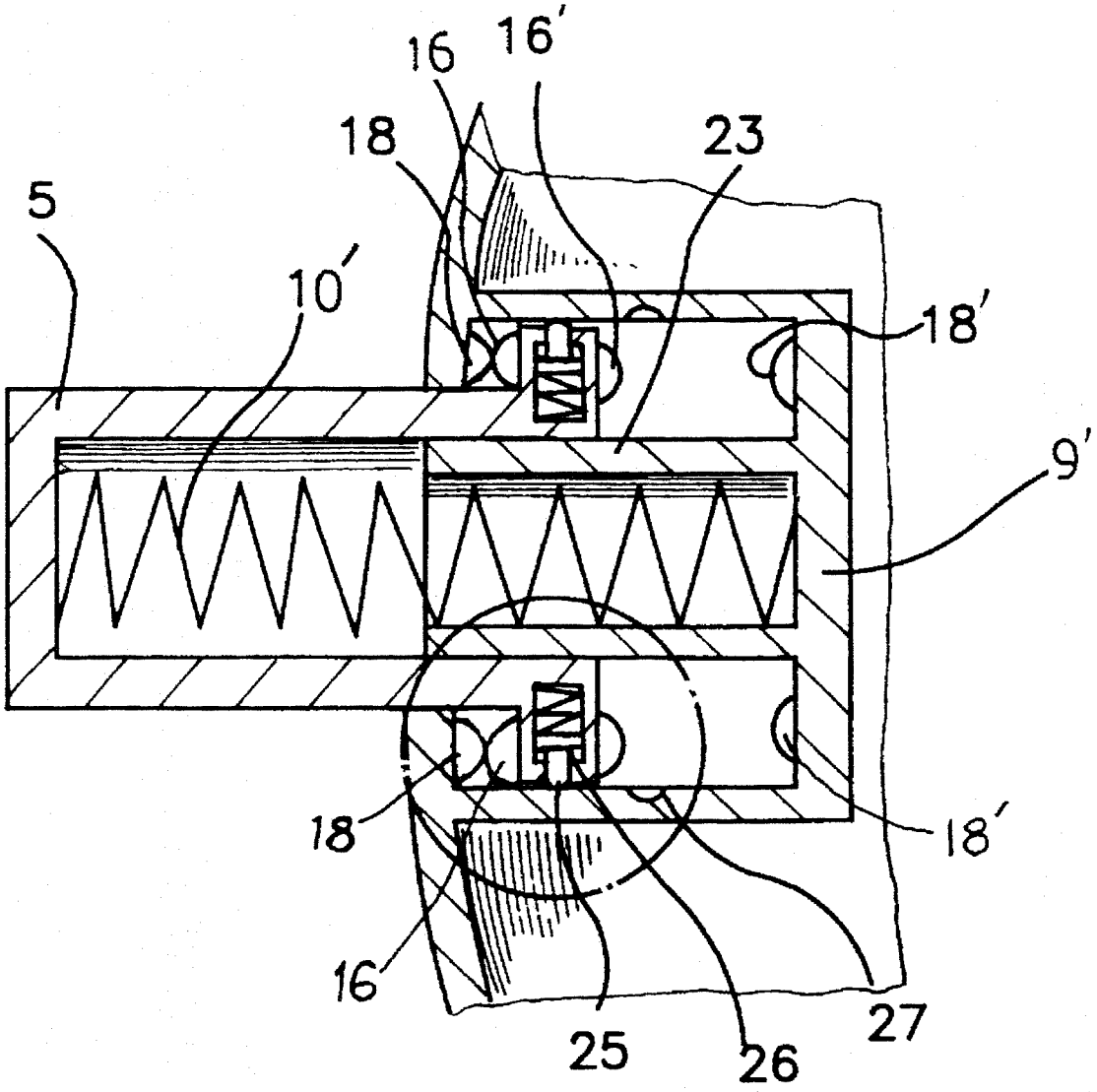
FIG. 4 is a partial view in an enlarged scale of the hand-muscle developer shown in FIG. 1*a*, showing the positioning of tuning key.

Referring to FIG. 4, the tuning means 5 is supported on a spring 10' in the tubular spring holder 23 of the key chamber 9'. The key chamber 9' has two opposite upper contacts 18, two opposite bottom contacts 18', and two opposite, recessed intermediate contacts 27. The tuning means 5 comprises two fixed upper contacts 16, two fixed bottom contacts 16', and two movable intermediate contacts 25 respectively supported on a respective spring 26 in a respective spring holder 24 (see also FIG. 5*b*). The contacts 18, 18', and 27 are electrically connected to respective contacts (not shown) on the music IC circuit board 7. When the tuning means 5 receives no pressure, it is disposed at the top position with the upper contacts 16 respectively connected to the upper contacts 18, causing the music IC circuit board 7 tuned to a first mode.

Figure 5B:
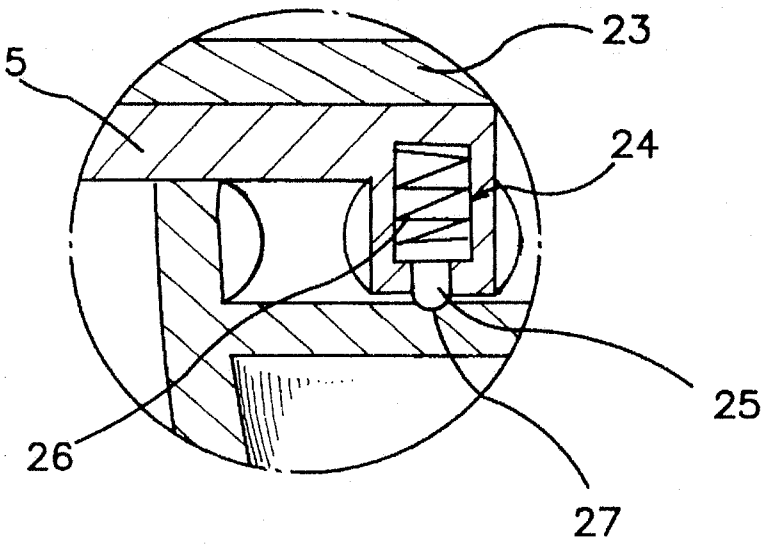
FIG. 5*b* is a partial view in an enlarged scale taken on part of FIG. 5*a*.
Figure 5A:
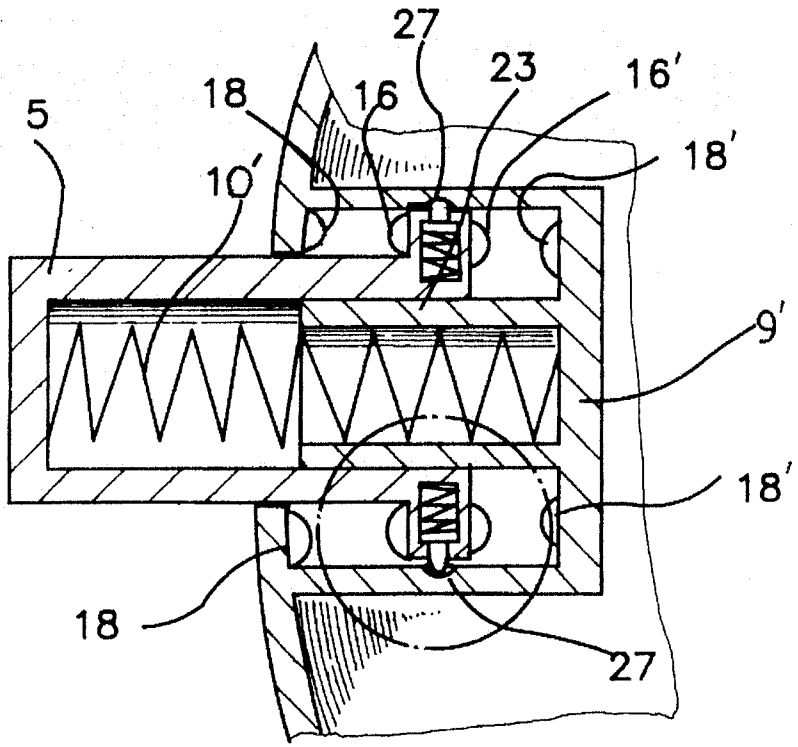
FIG. 5*a* is similar to FIG. 4 but showing the tuning key disposed in the middle position.

Referring to FIGS. 5*a* and 5*b*, when the tuning means 5 is moved downwards to the recessed intermediate contacts 27, the movable intermediate contacts 25 are forced outwards by the springs 26 to contact the recessed intermediate contacts 27, causing the music IC circuit board 7 tuned to a second mode.

Figure 6:
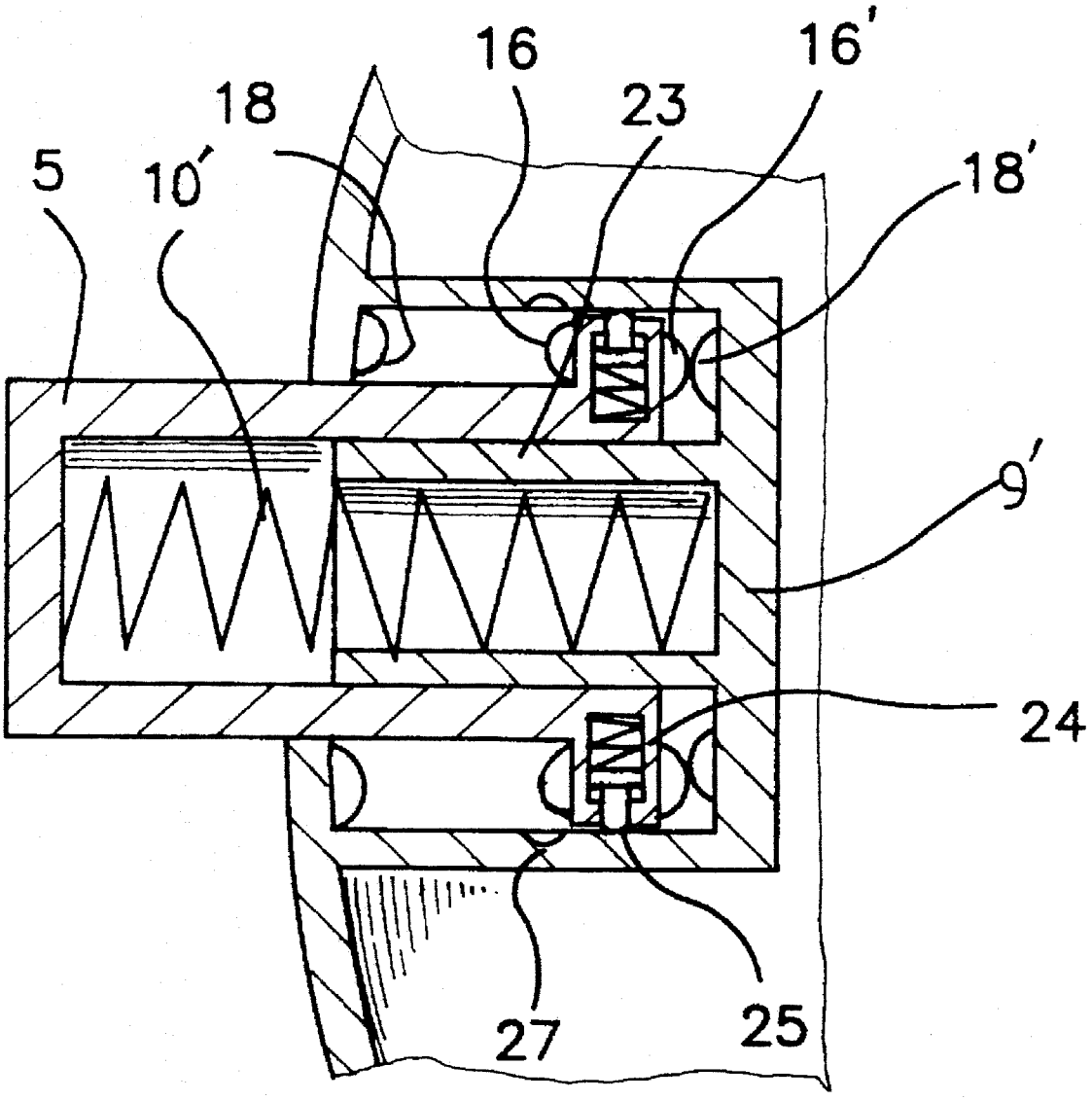
FIG. 6 is similar to FIG. 4 but showing the tuning key disposed in the bottom position.

Referring to FIG. 6, when the tuning means 5 is moved to the bottom, the bottom contacts 16' are disposed in contact with the bottom contacts 18', causing the music IC circuit board 7 tuned to a third mode.

As indicated, when the thumb and the fingers are exercised to press the tuning means 5 and the melody keys 4, different tones are produced by the music IC circuit board 7 through the speaker 6.

While only one embodiment of the present invention has been shown and described, it will be understood that various modifications and changes could be made without departing from the spirit and scope of the invention. For example, the number of contacts on the tuning means 5 and the tuning key chamber 9' may be relatively increased to broaden the tuning range.

What is claimed is:

1. A hand-muscle developer comprising:

a casing having at least one melody key chamber, and a tuning key chamber;

a hand strap configured to fit the dimensions and contours of the hand, said strap fixed to the outside of said casing;

a music IC circuit board mounted inside said casing;

a speaker mounted on said casing and electrically connected to said music IC circuit board;

a battery power supply installed in said casing and electrically connected to said music IC circuit board;

at least one melody key slidably mounted in said at least one melody key chamber such that, when fully depressed, electrical contact is made with said at least one melody key chamber triggering said IC circuit board to produce a specific tone through said speaker; and a tuning means slidably mounted in said tuning key chamber for tuning the tones triggered by said melody keys.

2. The hand-muscle developer of claim 1 wherein said at least one melody key chamber comprises a tubular spring holder and a spring disposed in the tubular spring holder to support one melody key in the fully extended position.

3. The hand-muscle developer of claim 1 wherein said tuning key chamber comprises a tubular spring holder and a spring disposed in the tubular spring holder to support said tuning means in the fully extended position.

4. The hand-muscle developer of claim 1 wherein said casing has legs raised from an outside wall thereof for supporting said casing above a flat surface.

5. The hand-muscle developer of claim 1 wherein said tuning key chamber comprises a pair of upper contacts, a pair of bottom contacts, and a pair of intermediate contacts respectively electrically connected to respective contacts on said music IC circuit board; said tuning means comprises a pair of fixed upper contacts, which are respectively connected to the pair of upper contacts of said tuning key chamber to tune the tones of said melody keys to a first mode when said tuning means is not depressed, a pair of fixed bottom contacts, which are respectively connected to the pair of bottom contracts of said tuning key chamber to tune the tones of said melody keys to a second mode when said tuning means is fully depressed, and a pair of movable intermediate contacts respectively supported on a respective spring and spaced between said fixed upper contacts and said fixed bottom contacts, which are respectively connected to the pair of intermediate contacts of said tuning key chamber to tune the tones of said melody keys to a third mode when said tuning means is moved to an intermediate position.

* * * * *